US008251645B2

(12) United States Patent
Yu

(10) Patent No.: US 8,251,645 B2
(45) Date of Patent: Aug. 28, 2012

(54) FAN WITH CONCEALED OSCILLATING MECHANISM

(76) Inventor: Steven Yu, Los Angeles, CA (US)

( * ) Notice: Subject to any disclaimer, the term of this patent is extended or adjusted under 35 U.S.C. 154(b) by 520 days.

(21) Appl. No.: 12/497,540

(22) Filed: Jul. 2, 2009

(65) Prior Publication Data

US 2011/0002784 A1 Jan. 6, 2011

(51) Int. Cl.
*F04D 29/00* (2006.01)

(52) U.S. Cl. ..... 415/121.2; 415/125; 415/126; 416/170 R; 416/100; 416/172; 417/123.1

(58) Field of Classification Search ..... 416/100, 416/170 R, 172, 247 R, 110; 415/126, 121.2, 415/125; 417/423.1
See application file for complete search history.

(56) References Cited

U.S. PATENT DOCUMENTS

| | | | | |
|---|---|---|---|---|
| 2,166,987 | A * | 7/1939 | Fitzgerald | 74/47 |
| 2,618,434 | A * | 11/1952 | Farnsworth | 416/100 |
| 5,639,213 | A * | 6/1997 | Chi | 416/100 |
| 6,296,449 | B1 * | 10/2001 | Wang | 416/247 R |
| 7,104,753 | B2 * | 9/2006 | Eubank et al. | 415/121.2 |
| 7,217,098 | B2 * | 5/2007 | Lim | 416/100 |
| 7,594,798 | B1 * | 9/2009 | Bucher et al. | 416/100 |
| 7,771,167 | B2 * | 8/2010 | Fu | 416/100 |
| 2005/0123402 | A1 * | 6/2005 | Lim | 416/100 |
| 2008/0304969 | A1 * | 12/2008 | Fu | 416/148 |
| 2011/0052394 | A1 * | 3/2011 | Kalhofer | 416/100 |

FOREIGN PATENT DOCUMENTS

JP 62035094 A * 2/1987

* cited by examiner

*Primary Examiner* — Edward Look
*Assistant Examiner* — Christopher R Legendre
(74) *Attorney, Agent, or Firm* — Rabin & Berdo, P.C.

(57) ABSTRACT

A fan with concealed oscillating mechanism includes a main housing, a first driving motor, a second driving motor and a curved link gear all located inside the main housing, and a set of blades located outside the main housing and connected to a rotating shaft of the first driving motor. The first driving motor has a connecting rod rotatably received in a receiving tube provided in the main housing. The second driving motor is located behind and connected to the first driving motor, and has a rotating shaft being perpendicular to that of the first driving motor. The curved link gear is connected at an end to the second rotating shaft and at another end to the main housing, such that when the second driving motor operates, the first driving motor is brought to oscillate while the set of blades stably rotates to thereby change the direction of produced airflow.

9 Claims, 10 Drawing Sheets

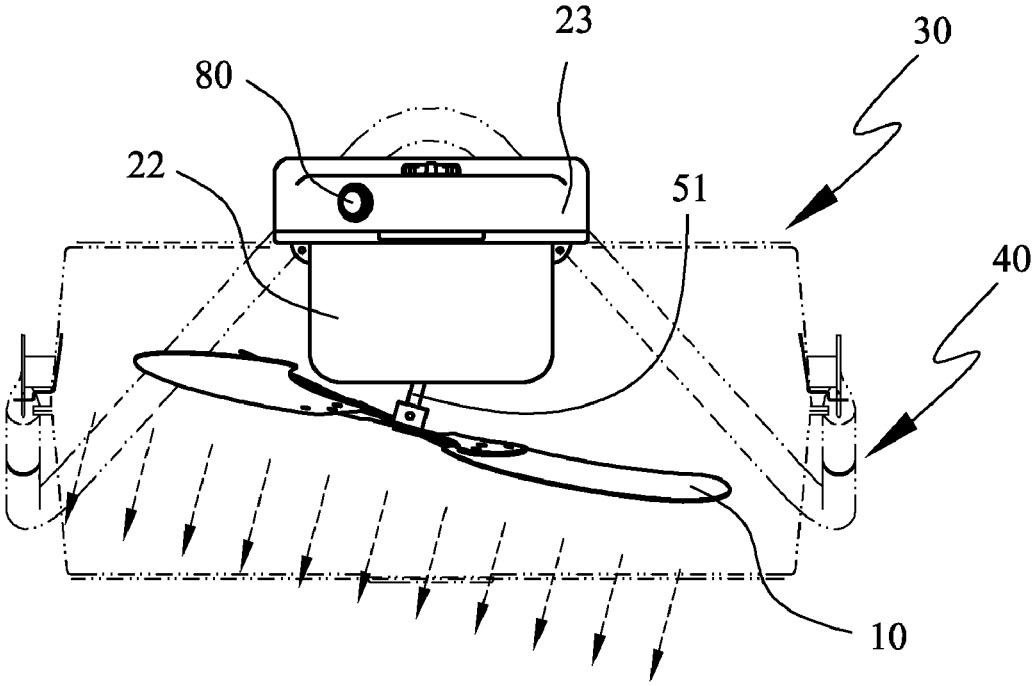
FIG. 7
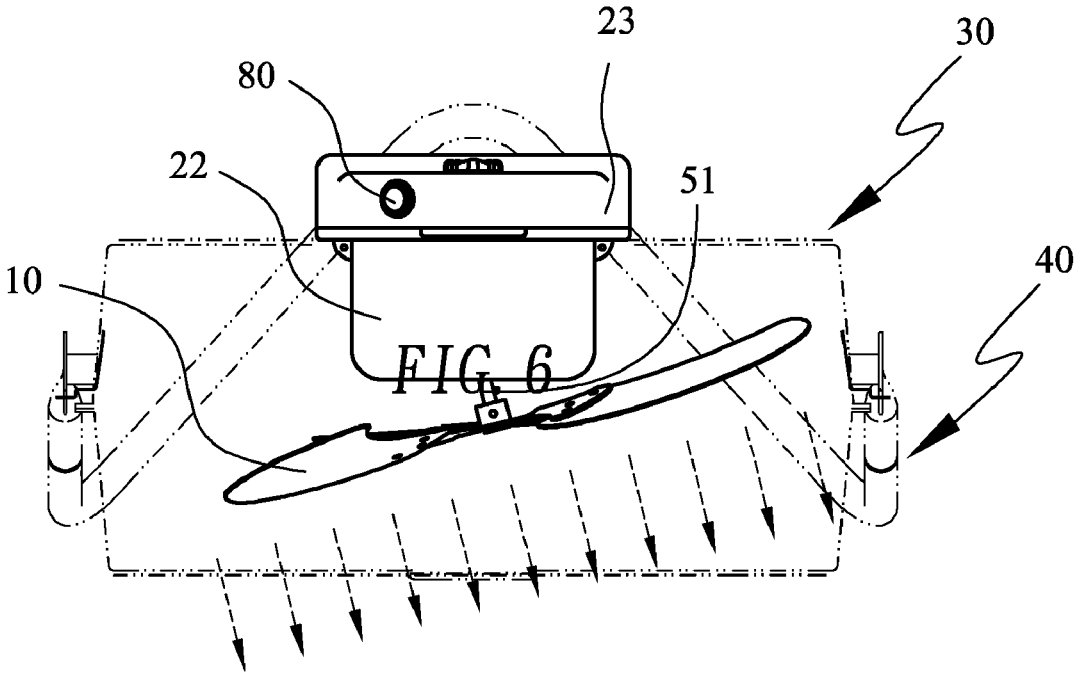
FIG. 6
FIG. 8

FAN WITH CONCEALED OSCILLATING MECHANISM

FIELD OF THE INVENTION

The present invention relates to a fan having an oscillating mechanism, and more particularly to a fan having an oscillating mechanism that is concealed in a main housing of the fan to oscillate a set of rotating blades under control.

BACKGROUND OF THE INVENTION

An electric fan usually includes a set of blades having a curved configuration each. The set of blades is driven by a driving motor to rotate, so that air is sucked into the fan from one side of the blades and then blown out of the fan from the other side of the blades to thereby produce airflow toward a target object. However, the blades can only produce linearly moved airflow. To direct the linearly moved airflow produced by the fan to different directions, an oscillating mechanism must be additionally provided for the fan.

According to the oscillating mechanisms thereof, the currently available fans can be generally divided into two types, namely, a cover-rotating fan and an oscillating fan.

The cover-rotating fan includes an air guiding mechanism arranged at a front side of the overall fan structure. The air guiding mechanism normally includes a plurality of parallelly spaced tilted slats. When the air guiding mechanism is rotated, the originally linearly moved airflow produced by the fan meets the rotating tilted slats and is automatically directed to different flowing directions to thereby produce a widened breezy area.

To achieve the purpose of directing the airflow to different directions, the tilted slats of the air guiding mechanism for the fan are usually densely arranged. Dust tends to accumulate in the small spaces between the densely arranged tilted slats, and the densely arranged tilted slats would adversely restrict the range of airflow to result in lowered cooling efficiency.

The oscillating fan is a fan provided in a base thereof with a rotary mechanism for producing an oscillating motion of the fan. That is, the rotary mechanism reciprocatingly rotates a main shaft of the fan to thereby change the direction of the produced airflow. When the oscillating fan operates, the whole fan oscillates about the rotary mechanism to swing to and fro sidewardly within a large span.

However, the sideward oscillation of the fan within a large span does not guide the airflow upward and downward. Therefore, the sideward oscillating fan is not suitable for some special working environment that requires vertical airflow. Further, the rotary mechanism of the oscillating fan has a gear set that is subject to wearing due to unbalanced weight undertaken by the rotary mechanism. The worn-out gear set results in a fan that tends to jig or halt during oscillating and accordingly has reduced operating efficiency and shortened service life.

On the other hand, most of the current industrial fans have metal-made blades and a powerful driving motor for rotating the blades at high speed, so as to meet the requirement of producing a large amount of airflow. The conventional oscillating fan and cover-rotating fan have a structure that fails to meet the requirement of the industrial fans. For the purpose of directing the airflow produced by the general industrial fan to different directions, the industrial fan is normally manually oriented to different directions. When orienting the industrial fan to different directions with a hand, there is a potential risk in the safety of using the industrial fan because the operator's hand might touch and be injured by the metal blades of the fan. Therefore, the conventional industrial fans have relatively low applicability.

In conclusion, the conventional fans, no matter what type of rotary mechanism is adopted, have the disadvantage of limited airflow direction or non-adjustable airflow direction. Further, the large-size industrial fans also have the problems of lacking available oscillating mechanism, uneasy to regulate airflow direction, and tending to injure the operator. Therefore, it is desirable to develop an improved oscillating mechanism for general fans.

SUMMARY OF THE INVENTION

A primary object of the present invention is to provide a fan with concealed oscillating mechanism, so that a set of blades of the fan driven to rotate can oscillate at the same time to change the direction of a produced airflow.

Another object of the present invention is to provide a fan with concealed oscillating mechanism, so that the fan can operate stably to provide upgraded airflow producing efficiency and reduce operating noise thereof.

To achieve the above and other objects, the fan with concealed oscillating mechanism according to a first preferred embodiment of the present invention includes a main housing, a first driving motor located inside the main housing, a second driving motor located behind and connected to the first driving motor, a curved link gear connected to and between the main housing and the second driving motor, and a set of blades located outside the main housing. The main housing is provided at a front end with an axially extended through-hole, and at an inner bottom with a receiving tube. The first driving motor has a first rotating shaft, which is forward extended through the through-hole to an outer side of the main housing, and a connecting rod located at a position corresponding to the receiving tube on the main housing. The connecting rod is rotatably fitted in the receiving tube, allowing the first driving motor to oscillate about the connecting rod relative to the receiving tube and accordingly the main housing. The second driving motor has a second rotating shaft that is extended in a direction perpendicular to that of the first rotating shaft. The curved link gear is connected at an end to the second rotating shaft of the second driving motor, and at another end to an inner side of the main housing. The set of blades is mounted on and connected to the first rotating shaft of the first driving motor.

The fan with concealed oscillating mechanism according to a second preferred embodiment of the present invention includes a main housing, a first driving motor located inside the main housing, a second driving motor located behind and connected to the first driving motor, a curved link gear connected to and between the main housing and the second driving motor, and a set of blades located outside the main housing. The main housing is provided at a front end with an axially extended through-hole, at an inner bottom with a receiving tube, and at an inner top with a holding tube. The first driving motor has a first rotating shaft, which is forward extended through the through-hole to an outer side of the main housing, a connecting rod located at a position corresponding to and rotatably fitted in the receiving tube on the main housing, and a holding rod located at a position corresponding to and rotatably fitted in the holding tube on the main housing, allowing the first driving motor to stably oscillate about the connecting rod and the holding rod relative to the receiving tube and the holding tube, respectively, and accordingly the main housing. The second driving motor has a second rotating shaft that is extended in a direction perpendicular to that of the first rotating shaft. The curved link gear is connected at an end to the second rotating shaft of the second driving motor, and at another end to an inner side of the main housing. The set of blades is mounted on and connected to the first rotating shaft of the first driving motor.

The main housings in the above-described two preferred embodiments each are assembled from a front cover and a mating rear cover, and the front cover further includes an upper front cover and a lower front cover that are assembled to each other to define the through-hole therebetween. The curved link gear includes a drive member and a curved link bar. The drive member is provided at an end with a shaft hole for engaging with the second rotating shaft, and at another end with a downward protrusion for engaging with a first end of the curved link bar. And, the curved link bar is provided at the first end with a receiving hole for engaging with the downward protrusion on the drive member, and at a second end with a locating hole for engaging with a locating tube provided on the inner bottom of the main housing. The fan further includes an oscillation control switch electrically connected to the second drive motor for starting or stopping the oscillation of the fan. In a preferred embodiment, the oscillation control switch is located on the main housing at an end opposite to the end with the through-hole.

The fan further includes a hood structure assembled to the main housing. The hood structure encloses the main housing and the set of blades therein and internally defines an oscillation space, which is large enough for the set of blades to rotate while oscillating sidewardly within the hood structure. The hood structure is assembled from a first hood and a second hood. The first hood is provided with a fitting opening corresponding to the main housing, so that the main housing is assembled and connected to the hood structure at the fitting opening. The second hood is configured corresponding to the first hood and assembled to a front side of the first hood, so as to define the oscillation space between the first and the second hood.

The fan further includes a stand connected to an outer side of the hood structure, such that the fan is stably supported on the stand for use. The stand includes two spaced supporting bars having upper ends connected to two lateral outer sides of the hood structure, and a base being configured to horizontally extend between lower ends of the two supporting bars to define a supporting plane, so that the fan can be stably supported on the stand for use on a floor.

The present invention is characterized in that the first driving motor inside the main housing brings the set of blades to rotate, while the second driving motor and the curved link gear inside the main housing cooperate with each other to bring the first driving motor and accordingly the set of blades to reciprocatingly oscillate sidewardly about the connecting rod. With the connecting rod on the first driving motor fitly and rotatably received in the receiving tube on the main housing, the set of blades mounted on the first rotating shaft of the first driving motor can stably oscillate while rotating to thereby change the direction of the produced airflow.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIGS. 7 and 8 show the manner in which the blades of the fan of the present invention oscillate while rotating;

DETAILED DESCRIPTION OF THE PREFERRED EMBODIMENTS

Figure 1:
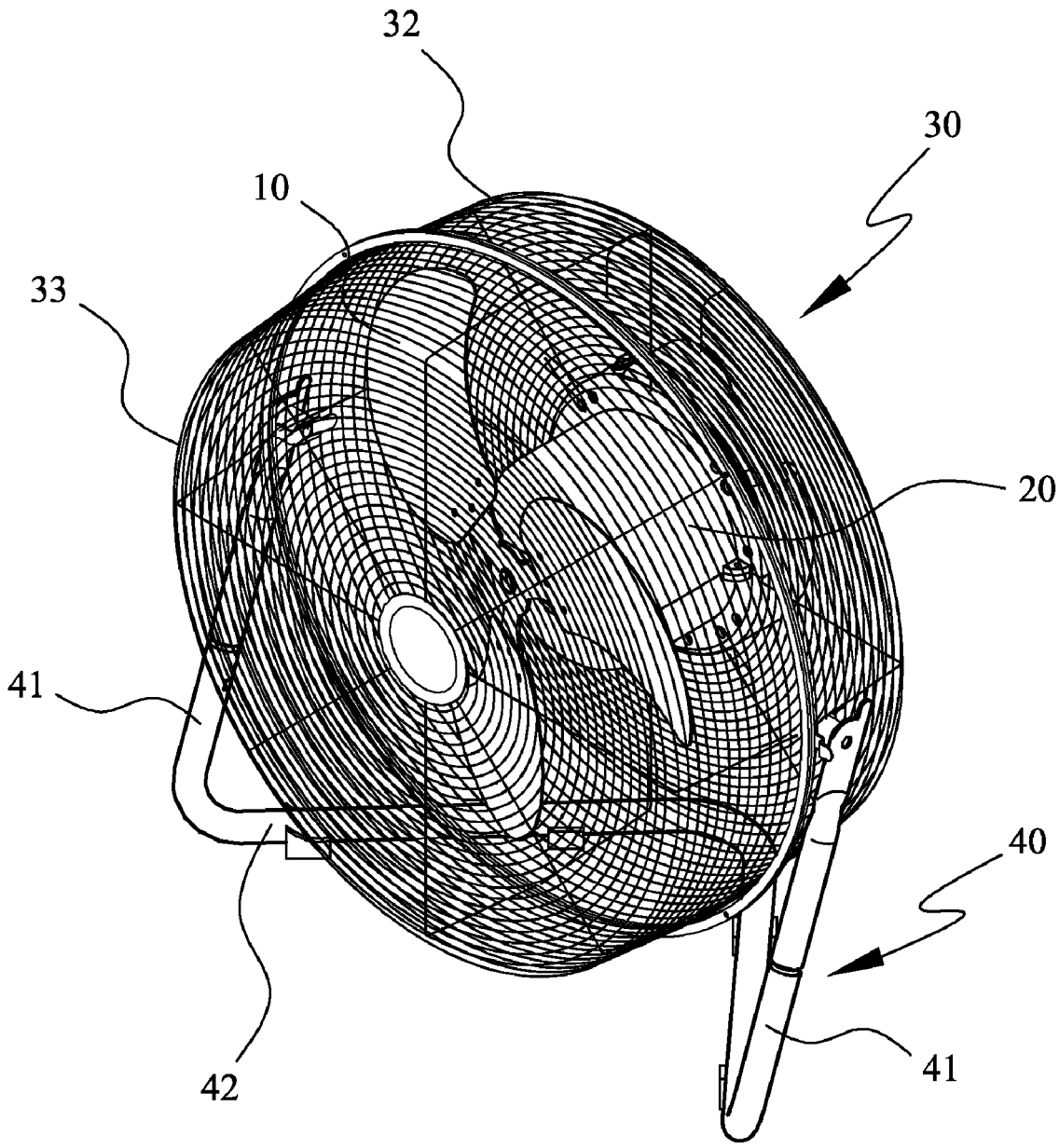
FIG. 1 is an assembled front perspective view of a fan with concealed oscillating mechanism according to a first preferred embodiment of the present invention.
Figure 2:
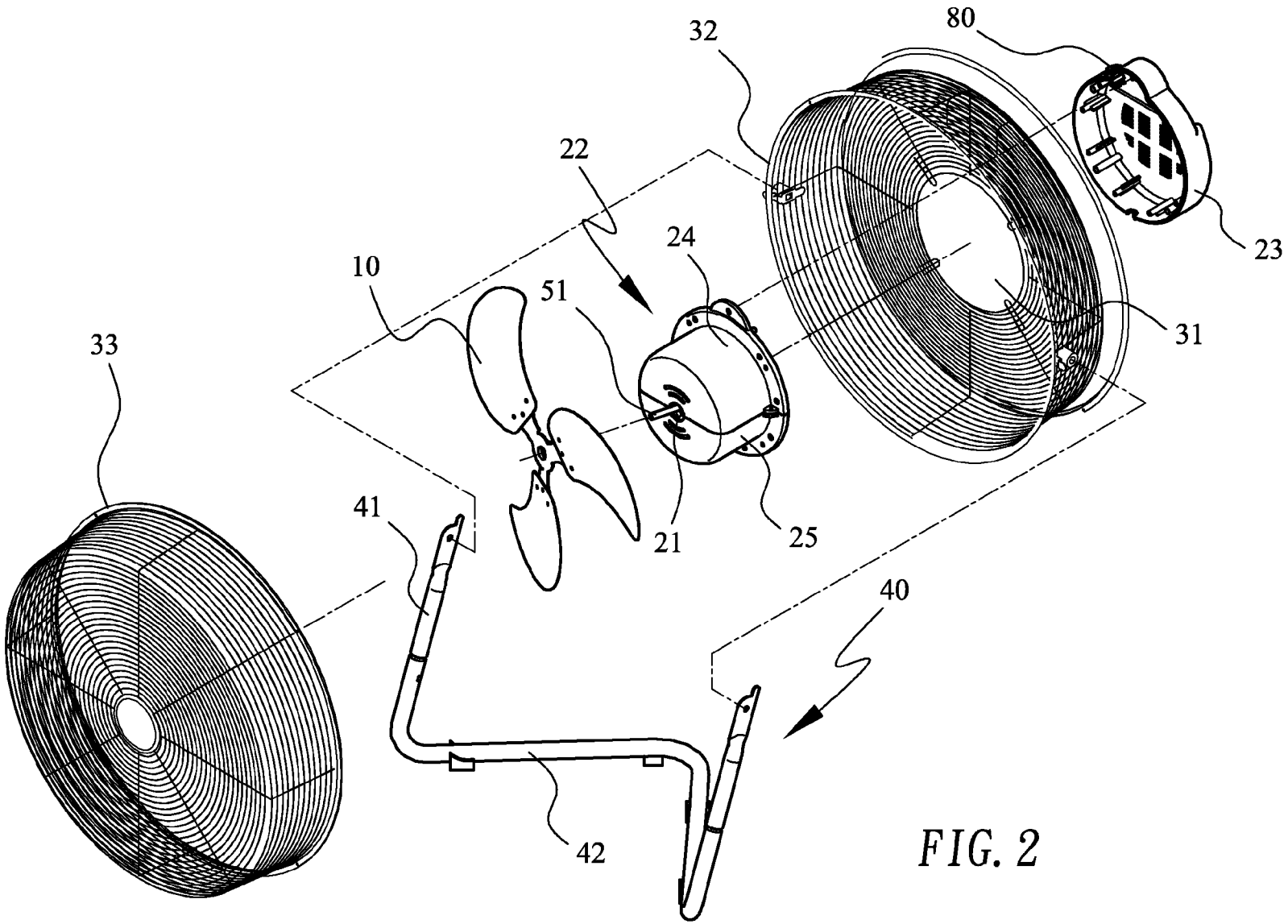
FIG. 2 is an exploded view of FIG. 1.

Please refer to FIGS. 1 and 2 that are assembled and exploded perspective views, respectively, of a fan with concealed oscillating mechanism according to a preferred embodiment of the present invention. As shown, the fan includes a set of blades 10, a main housing 20 having driving mechanisms received therein, a hood structure 30, and a stand 40. The set of blades 10 is connected to the driving mechanisms inside the main housing 20 that is assembled to and enclosed in the hood structure 30. The stand 40 is connected to an outer side of the hood structure 30 to stably position the whole fan on a floor for use.

Figure 3:
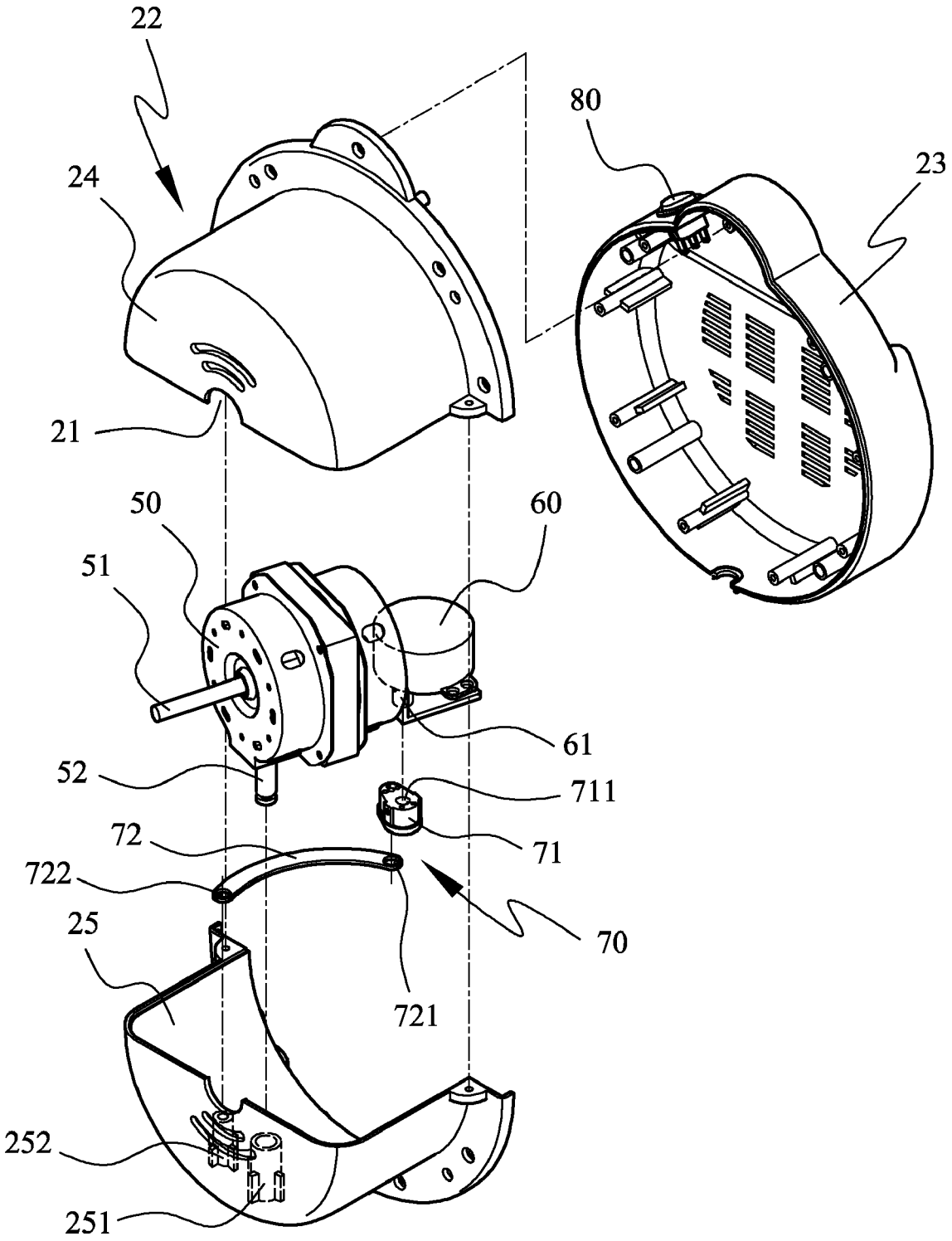
FIG. 3 is a front exploded perspective view showing the detailed structure inside a main housing for the fan according to the first preferred embodiment of the present invention.
Figure 4:
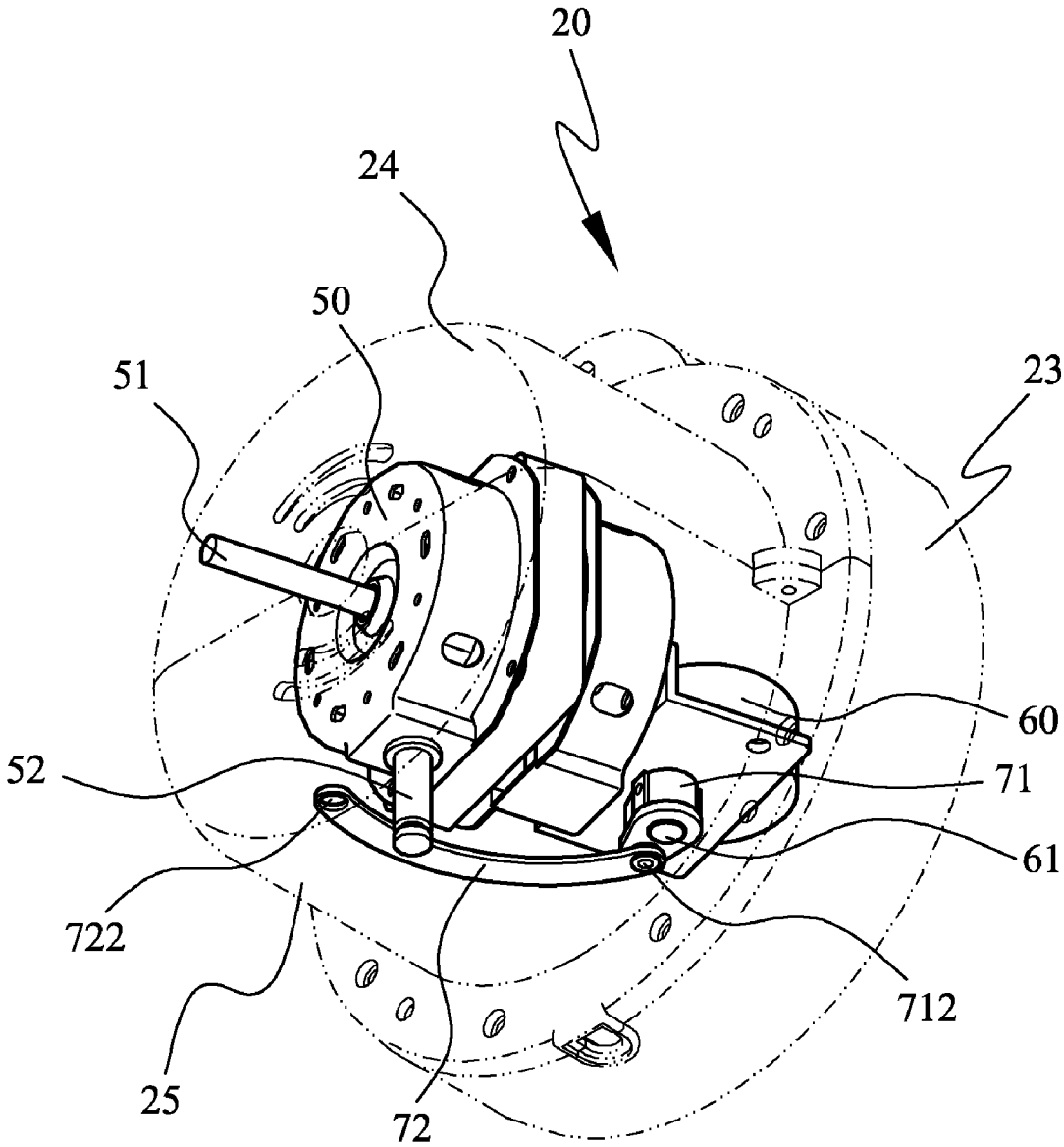
FIG. 4 is an assembled phantom perspective view of FIG. 3.
Figure 5:
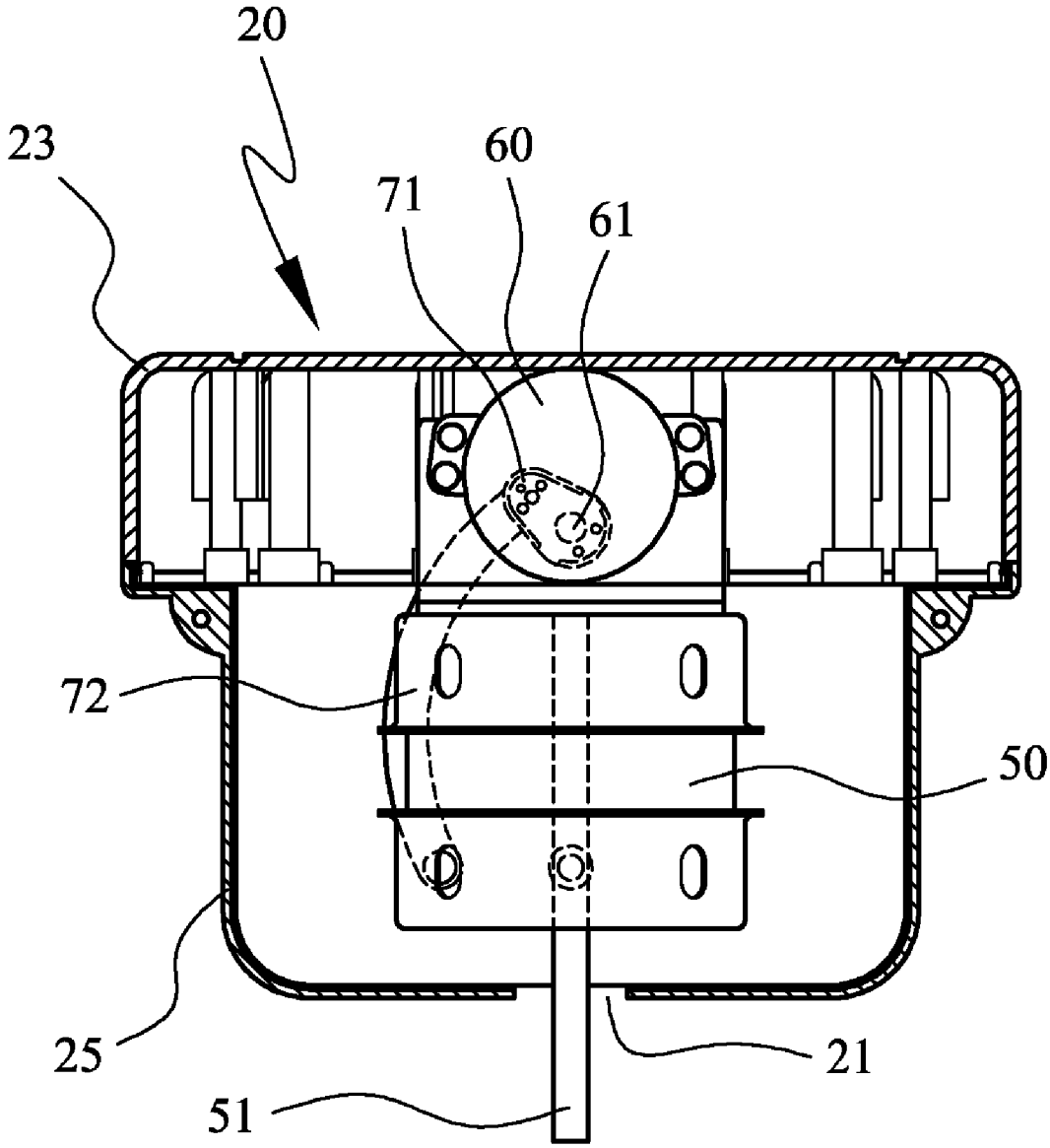
FIG. 5 is a sectioned top view of FIG. 4.

Please refer to FIGS. 3, 4 and 5 at the same time. The main housing 20 is provided at an end adjacent to the set of blades 10 with an axially extended through-hole 21, and at an inner bottom with a radially inward extended receiving tube 251. In the illustrated preferred embodiment, the main housing 20 is assembled from a front cover 22 and a mating rear cover 23. The front cover 22 further includes an upper front cover 24 and a lower front cover 25 that together define the through-hole 21 therebetween. The receiving tube 251 is arranged on an inner surface of the lower front cover 25.

The driving mechanisms inside the main housing 20 include a first driving motor 50, a second driving motor 60, and a curved link gear 70. The first driving motor 50 includes a first rotating shaft 51, which is forward extended through the through-hole 21 to an outer side of the main housing 20. A connecting rod 52 is provided on the first driving motor 50 at a position corresponding to the receiving tube 251 for rotatably fitting in the receiving tube 251, so that the first driving motor 50 is able to oscillate about the connecting rod 52 relative to the receiving tube 251 and accordingly the main housing 20. The set of blades 10 is assembled to a section of the first rotating shaft 51 that is forward projected from the main housing 20 via the through-hole 21.

The second driving motor 60 is located behind and connected to the first driving motor 50, and includes a second rotating shaft 61 extended in a direction perpendicular to that of the first rotating shaft 51.

The curved link gear 70 is connected at a first end to the second rotating shaft 61 of the second driving motor 60, and at a second end to a locating tube 252 that is also provided on the inner bottom of the main housing 20. In the illustrated preferred embodiment, the curved link gear 70 includes a drive member 71 and a curved link bar 72. The drive member 71 is provided at an end with a shaft hole 711 for engaging with the second rotating shaft 61, and at another end with a downward protrusion 712 for engaging with a first end of the curved link bar 72, as can be seen in FIG. 4. The curved link bar 72 is provided at the first end with a receiving hole 721 for engaging with the downward protrusion 712 on the drive member 71, and at a second end with a locating hole 722 for engaging with the locating tube 252 on the main housing 20.

In a preferred embodiment, the main housing 20 for the fan of the present invention has an oscillation control switch 80 provided thereon. The oscillation control switch 80 is located on the main housing 20 at an end opposite to the end with the through-hole 21, and is electrically connected to the second driving motor 60 for starting or stopping the oscillating motion of the fan.

Please refer to FIGS. 1 and 2 again. The hood structure 30 encloses the main housing 20 and the set of blades 10 therein. The hood structure 30 internally defines an oscillation space 31 large enough for the set of blades 10 to rotate and oscillate therein. In the illustrated preferred embodiment, the hood structure 30 is assembled from a first hood 32 and a second hood 33. The first hood 32 is provided with a fitting opening 321 corresponding to the main housing 20, so that the main housing 20 is assembled to the first hood 32 at the fitting opening 321. The second hood 33 is configured corresponding to and assembled to a front side of the first hood 32, so as to define the oscillation space 31 between the first and the second hood 32, 33.

The stand 40 is externally assembled to two lateral sides of the hood structure 30. The stand 40 includes two spaced and upward extended supporting bars 41 having upper ends connected to the two lateral sides of the hood structure 30, and a base 42 being configured to horizontally extend between lower ends of the two supporting bars 41 to define a supporting plane, so that the fan can be stably supported on the stand 40 for use on a floor. However, it is understood the stand 40 is not necessarily limited to the above described configuration. Instead, the stand 40 can be otherwise a suspender hanging from a ceiling, a mount fixed on a wall or the like to meet different requirements for using the fan.

Figure 6:
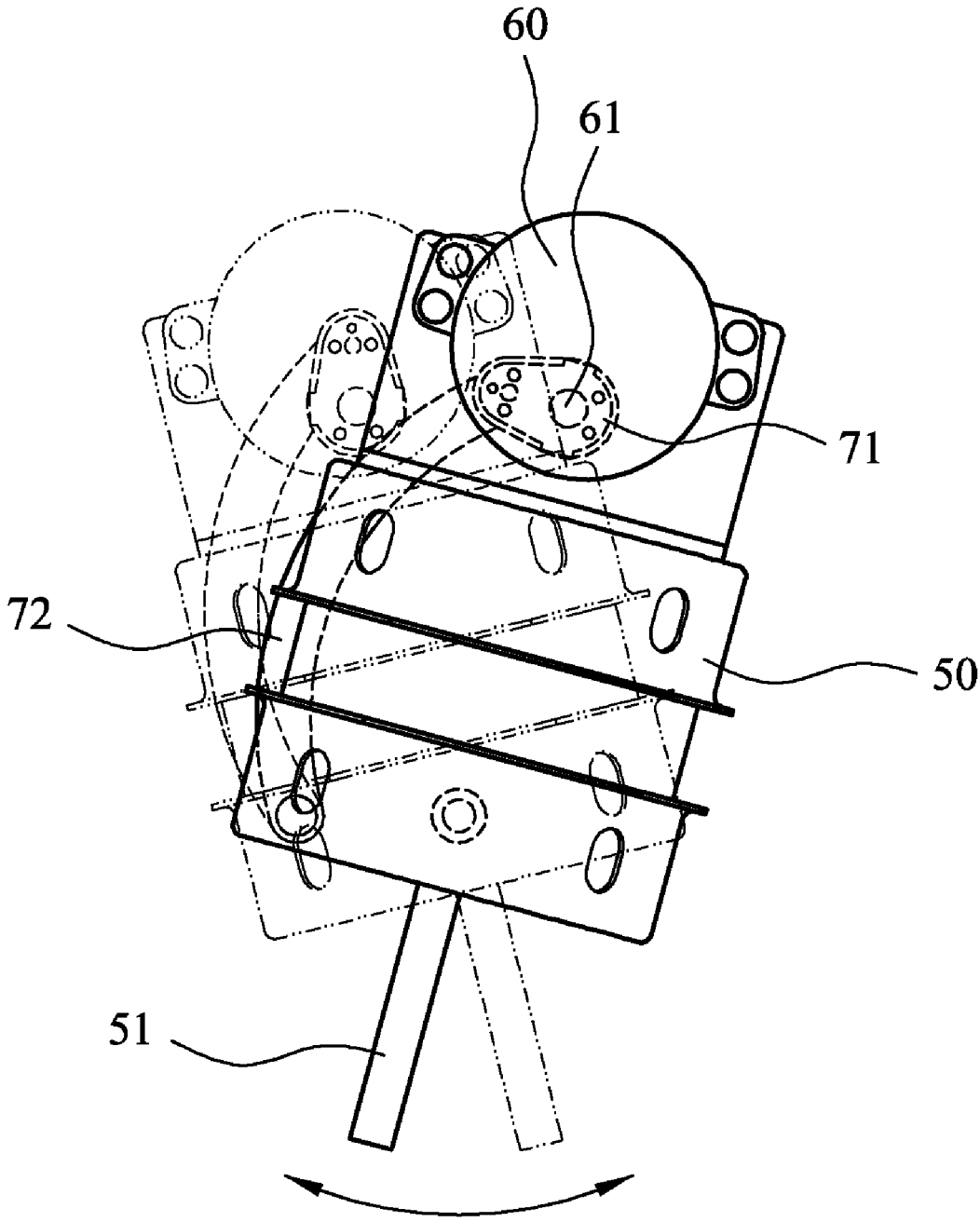
FIG. 6 shows the manner in which two driving motors for the fan of the present invention operate to oscillate.

Please refer to FIGS. 5 and 6. When the first driving motor 50 operates and brings the first rotating shaft 51 to rotate, the set of blades 10 will rotate to suck in air from the first hood 32 located at a rear side of the hood structure 30. Meanwhile, the second hood 33 located at a front side of the hood structure 30 will linearly convey the airflow forward. And, when the second driving motor 60 operates and brings the second rotating shaft 61 to rotate, the second rotating shaft 61 will further bring the drive member 71 of the curved link gear 70 to move in a circular motion. Since the drive member 71 is fixedly connected at an end to the first end of the curved link bar 72, and the curved link bar 72 is connected at the second end to the locating tube 252 on the main housing 20, the first driving motor 50 and the first rotating shaft 51 thereof are brought by the second driving motor 60 and the curved link gear 70 to reciprocatingly oscillate about the connecting rod 52.

As can be seen from FIGS. 7 and 8, with the above arrangements, the hood structure 30 of the fan of the present invention can remain in a stationary state while the set of blades 10 rotates and oscillates to and fro within the oscillation space 31 defined in the hood structure 30 to achieve the purpose of directing the produced linear airflow to different directions.

Figure 9:
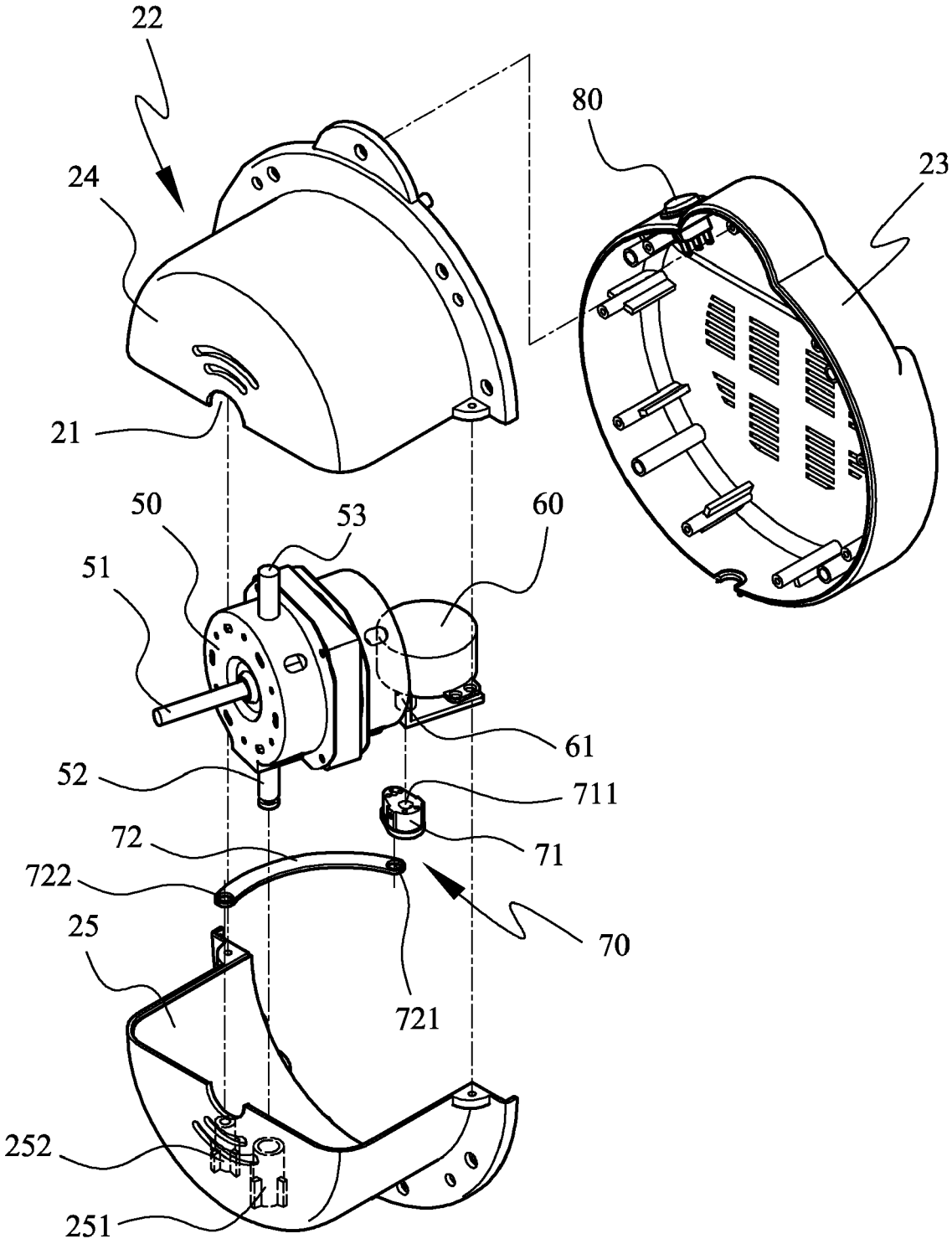
FIG. 9 is a front exploded perspective view showing the detailed structure inside a main housing for the fan according to a second preferred embodiment of the present invention.
Figure 10:
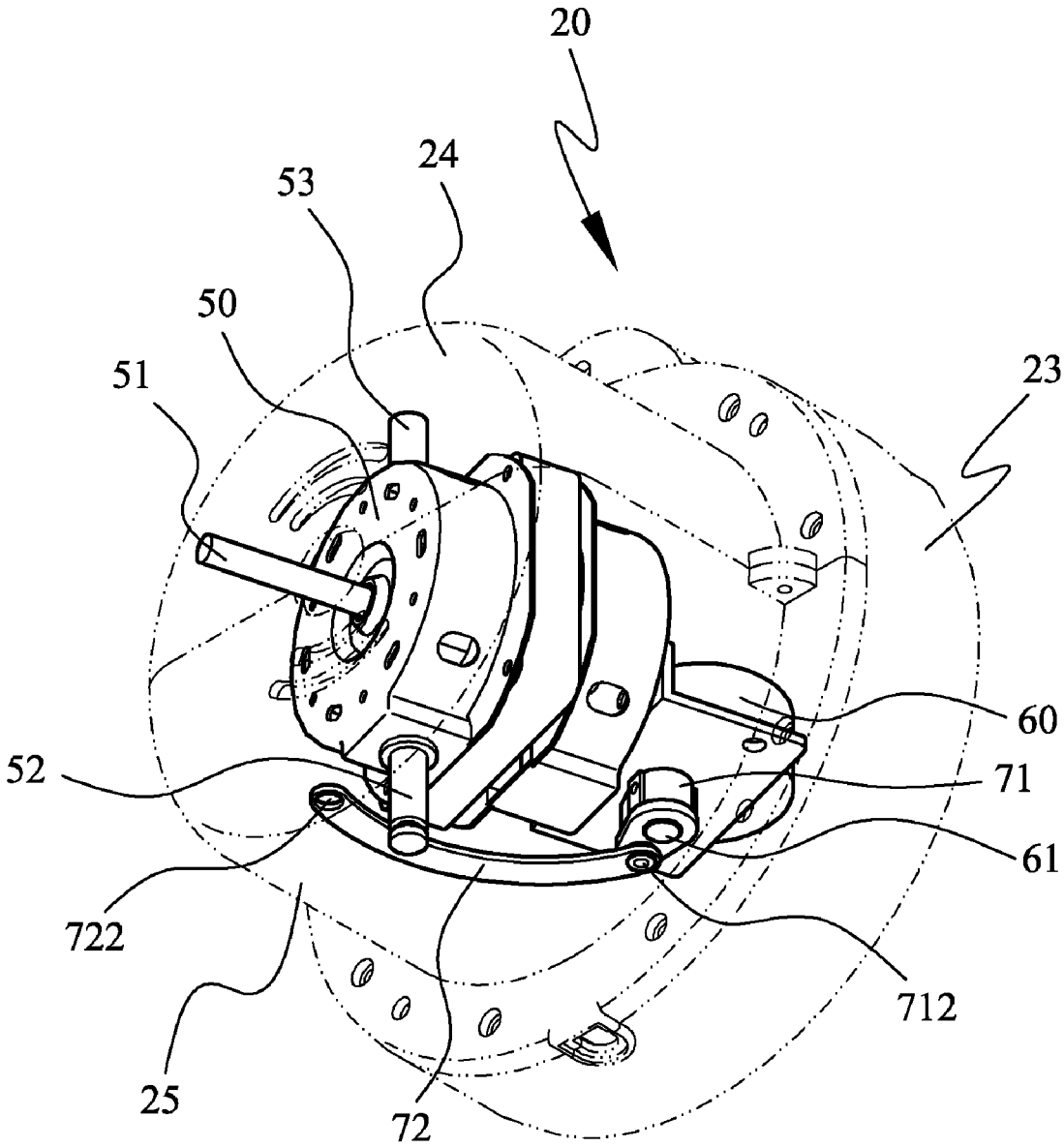
FIG. 10 is an assembled phantom perspective view of FIG. 9.
Figure 11:
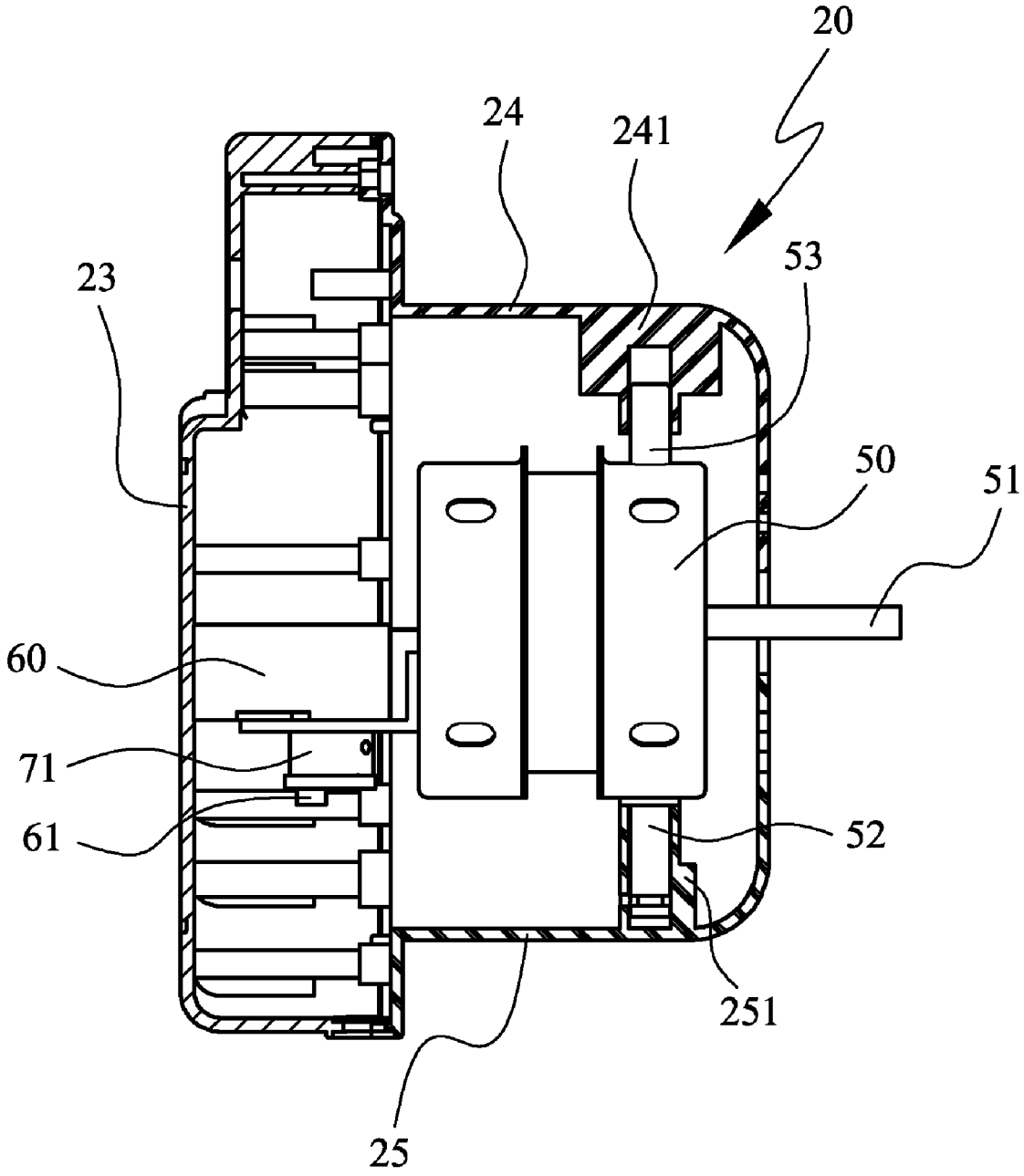
FIG. 11 is a sectioned side view of FIG. 10.

Please refer to FIGS. 9 to 11. The concealed oscillating mechanism for the fan according to a second preferred embodiment of the present invention includes a main housing 20 internally provided with a driving mechanism. The main housing 20 is provided at an end adjacent to the set of blades 10 with an axially extended through-hole 21, at an inner bottom with a radially inward extended receiving tube 251, and at an inner top with a radially inward extended holding tube 241 oppositely corresponding to the receiving tube 251.

In the illustrated second preferred embodiment, the main housing 20 is assembled from a front cover 22 and a mating rear cover 23. The front cover 22 further includes an upper front cover 24 and a lower front cover 25 that together define the through-hole 21 therebetween. The receiving tube 251 is arranged on an inner surface of the lower front cover 25, and the holding tube 241 is arranged on an inner surface of the upper front cover 24.

The driving mechanisms inside the main housing 20 include a first driving motor 50, a second driving motor 60, and a curved link gear 70. The first driving motor 50 includes a first rotating shaft 51, which is forward extended through the through-hole 21 to an outer side of the main housing 20. A connecting rod 52 is provided on the first driving motor 50 at a position corresponding to the receiving tube 251 on the main housing 20, and a holding rod 53 is provided on the driving motor 50 at a position corresponding to the holding tube 241 on the main housing 20.

The set of blades 10 is assembled to a section of the first rotating shaft 51 that is forward projected from the main housing 20 via the through-hole 21. The connecting rod 52 is rotatably fitted in the receiving tube 251, and the holding rod 53 is rotatably fitted in the holding tube 241, so that the first driving motor 50 is able to oscillate about the connecting rod 52 and the holding rod 53 relative to the receiving tube 251 and the holding tube 241, respectively, and accordingly the main housing 20, allowing the fan to oscillate in a more stable manner.

The second driving motor 60 is located behind and connected to the first driving motor 50, and includes a second rotating shaft 61 extended in a direction perpendicular to that of the first rotating shaft 51.

The curved link gear 70 is connected at a first end to the second rotating shaft 61 of the second driving motor 60, and at a second end to a locating tube 252 that is also provided on the inner bottom of the main housing 20. In the illustrated preferred embodiment, the curved link gear 70 includes a drive member 71 and a curved link bar 72. The drive member 71 is provided at an end with a shaft hole 711 for engaging with the second rotating shaft 61, and at another end with a downward protrusion 712 for engaging with a first end of the curved link bar 72, as can be seen in FIG. 4. The curved link bar 72 is provided at the first end with a receiving hole 721 for engaging with the downward protrusion 712 on the drive member 71, and at a second end with a locating hole 722 for engaging with the locating tube 252 on the main housing 20.

With these arrangements, the hood structure 30 of the fan according to the second preferred embodiment of the present invention can also remain in a stationary state while the set of blades 10 rotates and oscillates to and fro within the oscillation space 31 defined in the hood structure 30 to achieve the purpose of directing the produced linear airflow to different directions.

In brief, the first driving motor 50 inside the main housing 20 of the fan of the present invention brings the set of blades 10 to rotate, and the second driving motor 60 cooperates with the curved link gear 70 to cause sideward oscillation of the first driving motor 50 and accordingly the set of blades 10 about the connecting rod 52 to thereby change the direction of the produced airflow. Further, with the connecting rod 52 on the first driving motor 50 being fitly and rotatably received in the receiving tube 251 on the main housing 20, the set of blades 10 is able to stably rotate while the first driving motor 50 oscillates about the connecting rod 52. As a result, the fan of the present invention has upgraded airflow producing efficiency and reduced operating noise.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A fan with concealed oscillating mechanism, comprising:

a main housing being provided at an end with an axially extended through-hole and at an inner bottom with a radially inward extended receiving tube and at an inner top with a radially inward extended holding tube;

a first driving motor being located inside the main housing and having a first rotating shaft forward extended through the through-hole to an outer side of the main housing; the first driving motor being provided at a position corresponding to the receiving tube and the holding tube on the main housing with a connecting rod and a holding rod, enabling the fan to oscillate at increased stability, and the connecting rod being rotatably fitted in the receiving tube to allow the first driving motor to reciprocatingly oscillate about the connecting rod relative to the receiving tube and the main housing;

a second driving motor being located inside the main housing behind and connected to the first driving motor, and having a second rotating shaft extended in a direction perpendicular to that of the first rotating shaft;

a curved link gear being connected at a first end to the second rotating shaft of the second driving motor and at a second end to the inner bottom of the main housing; and a set of blades being located at an outer side of the main housing and connected to the first rotating shaft of the first driving motor.

2. The fan with concealed oscillating mechanism as claimed in claim 1, wherein the main housing is assembled from a front cover and a mating rear cover, and the front cover further includes an upper front cover and a lower front cover that together define the through-hole therebetween.

3. The fan with concealed oscillating mechanism as claimed in claim 1, wherein the curved link gear includes a drive member and a curved link bar; the drive member being provided at an end with a shaft hole for engaging with the second rotating shaft and at another end with a downward protrusion for engaging with a first end of the curved link bar; the curved link bar being provided at the first end with a receiving hole for engaging with the downward protrusion on the drive member, and at a second end with a locating hole for engaging with a locating tube provided on the inner bottom of the main housing.

4. The fan with concealed oscillating mechanism as claimed in claim 1, further comprising an oscillation control switch, which is electrically connected to the second driving motor for starting and stopping an oscillation motion of the fan.

5. The fan with concealed oscillating mechanism as claimed in claim 4, wherein the oscillation control switch is located on the main housing at an end opposite to the end with the through-hole.

6. The fan with concealed oscillating mechanism as claimed in claim 1, further comprising a hood structure assembled to the main housing; the hood structure enclosing the main housing and the set of blades therein and internally defining an oscillation space, which is large enough for the set of blades to rotate and oscillate therein.

7. The fan with concealed oscillating mechanism as claimed in claim 6, wherein the hood structure includes a first hood and a second hood; the first hood being provided with a fitting opening corresponding to the main housing, such that the main housing is assembled to the first hood at the fitting opening; and the second hood being configured corresponding to and assembled to a front side of the first hood to thereby define the oscillation space between the first and the second hood.

8. The fan with concealed oscillating mechanism as claimed in claim 6, further comprising a stand externally connected to two lateral sides of the hood structure, such that the fan is stably supported on the stand for use.

9. The fan with concealed oscillating mechanism as claimed in claim 8, wherein the stand includes two spaced supporting bars having first ends connected to the two lateral sides of the hood structure, and a base being configured to horizontally extend between second ends of the two supporting bars to define a supporting plane.

* * * * *